US009642500B2

(12) United States Patent
Groner et al.

(10) Patent No.: US 9,642,500 B2
(45) Date of Patent: May 9, 2017

(54) SHOWER ENCLOSURE

(75) Inventors: David M. Groner, Oil City, PA (US); Brian A. Milford, Venus, PA (US)

(73) Assignee: Clarion Bathware, Inc., Shippenville, PA (US)

( * ) Notice: Subject to any disclaimer, the term of this patent is extended or adjusted under 35 U.S.C. 154(b) by 332 days.

(21) Appl. No.: 13/480,519

(22) Filed: May 25, 2012

(65) Prior Publication Data

US 2012/0297533 A1 Nov. 29, 2012

Related U.S. Application Data

(60) Provisional application No. 61/489,785, filed on May 25, 2011.

(51) Int. Cl.
*A47K 3/00* (2006.01)
*A47K 3/30* (2006.01)

(52) U.S. Cl.
CPC ..... *A47K 3/30* (2013.01)

(58) Field of Classification Search
USPC ..... 4/612; 411/401, 385, 380, 409, 390, 411/387.8, 379
See application file for complete search history.

(56) References Cited

U.S. PATENT DOCUMENTS 3,631,543 A 1/1972 Laauser
3,688,353 A 9/1972 Laauser
3,977,136 A 8/1976 Daniels
3,996,703 A 12/1976 Daniels
4,080,710 A * 3/1978 Hess ..... 29/416
4,384,377 A 5/1983 Calvert et al.
4,553,276 A 11/1985 Paradis
4,578,832 A 4/1986 Primucci
4,901,380 A 2/1990 Smith
4,987,619 A * 1/1991 Smith ..... 4/612
5,263,208 A 11/1993 Smith
5,671,489 A 9/1997 Salach
5,778,463 A * 7/1998 Teckchandani et al. ..... 4/538
6,425,147 B1 7/2002 Hanson
6,647,563 B1 * 11/2003 Smith ..... 4/584
6,662,503 B2 12/2003 Cowell et al.
6,895,609 B2 5/2005 Ingram et al.
7,979,926 B1 * 7/2011 Boegler ..... 4/599
2007/0240259 A1 * 10/2007 Dabrowski et al. ..... 4/584

* cited by examiner

*Primary Examiner* — Lauren Crane
(74) *Attorney, Agent, or Firm* — The Webb Law Firm

(57) ABSTRACT

A multi-piece shower enclosure includes a base section, a plurality of vertically extending sidewalls and a flange extending horizontally outward along a top portion of sidewalls. A back wall section is removably attachable to the base section, the back wall section having a ledge provided on the bottom portion of the back wall section. One or more side wall panels are removably attachable to the back wall section. A plurality of pins is used for securing the back wall section to the base section and the side wall panels to the back wall section. Each of the pins has a lower rivet portion and an upper threaded portion separated by a central portion. Each of the pins is insertable into a corresponding opening provided on the ledge of the back wall section or a side of the back wall portion adjoining each of the side wall panels.

18 Claims, 9 Drawing Sheets

SHOWER ENCLOSURE

CROSS-REFERENCE TO RELATED APPLICATIONS

This application claims priority to U.S. Provisional Patent Application No. 61/489,785, filed May 25, 2011, which is entirely incorporated herein by reference.

BACKGROUND OF THE INVENTION

Field of the Invention

This invention relates, in general, to multi-piece shower enclosures, and more particularly, to a device and method for assembly, shipping and installation of a multi-piece shower enclosure.

Description of the Related Art

Multi-piece shower enclosures are commonly installed in many residential and commercial establishments. Typically, multi-piece shower enclosures include a tub portion having a plurality of panels connected thereto. In some embodiments, a door is provided on at least one side of the tub portion for facilitating ingress and egress to and from the tub portion. Conventional multi-piece shower enclosures are generally manufactured as a plurality of separate pieces which are typically assembled at the point of installation. Each piece is preferably manufactured from a water-proof composite sheet material, such as fiberglass.

Due to the widespread use of multi-piece shower enclosures in a variety of applications, consumers and installers demand light-weight and cost-efficient units that are easily installed inside a framing pocket provided in a bathroom. A major problem with conventional multi-piece shower enclosures is that they generally must be assembled outside the framing pocket before the unit is installed. Shower enclosures are shipped in a disassembled state from a manufacturing facility and ultimately delivered to a point of final assembly. Installers must then fully assemble the shower enclosure outside the framing pocket and insert the assembled unit inside the framing pocket. This presents a particular problem when retrofitting existing bathrooms that already have walled framing pockets. Furthermore, because installers must secure the multi-piece shower enclosure from inside the framing pocket, the installation process becomes increasingly complicated in small bathrooms. This process is labor intensive, and therefore more time consuming and costly.

Current installation methods may require drilling various portions of the tub or the sidewall panels in order to secure these pieces to each other or to the sides of the framing pocket. Drilling can also cause problems in maintaining a water-tight seal between the individual components.

Current methods of assembly for multi piece shower enclosure units generally include the use plastic, friction-fit fasteners as well as the standard nut and bolt attachment systems. The standard nut and bolt fasteners provide a desirable solution for strength and versatility; however, they are associated with an added expense. The plastic, friction-fit pins do not meet the mandated American Disabilities Act (ADA) legislation for pull and sheer strength that is necessary for ADA accessories. This is particularly important in building multi-piece shower enclosures which incorporate grab bars.

An additional drawback of current assembly methods is that they utilize various types of fittings and couplings to secure the individual components of the shower enclosure. Such fittings and couplings are generally assembled at the point of installation and require additional installation steps, such as drilling, before the shower enclosure may be installed inside the framing pocket. This method of assembly is usually prohibitively expensive because it may require reinforcement of shower enclosure components where fittings and couplings are attached. Additionally, after shower enclosure components are installed using the conventional fittings and couplings, the shower enclosure cannot be easily disassembled. Due to the construction of these fittings, the individual panels are permanently affixed to each other. This prevents interchangeability of components for replacement or repair purposes.

In view of the foregoing, a need exists for a device and method for assembly, shipping and installation of multi-piece shower enclosures inside the framing pocket, whereby individual components of the shower enclosure may be easily assembled and disassembled without the need for drilling as required by conventional installation methods. An additional need exists for providing a device and method for assembly, shipping and installation of multi-piece shower enclosures having easily removable panels for shipping, assembly, replacement, and/or repair without causing damage. An additional need exists for an ADA-compliant grab bar system that can be installed from the front side of a tub or shower unit without requiring access to the back side of the tub or shower unit to secure the grab bar.

SUMMARY OF THE INVENTION

Further details and advantages of the present invention will become apparent from the following detailed description read in conjunction with the drawings.

According to one embodiment of the present invention, a multi-piece shower/tub shower unit may include a base section having a floor, a plurality of vertically extending sidewalls and a flange extending horizontally outward along a top portion of vertically extending sidewalls. The multi-piece shower enclosure may further include a back wall section removably attachable to the base section, the back wall section having a first surface facing the interior of the shower unit, a second surface opposite the first surface and facing a framing pocket for installing the shower unit. A ledge may be provided on the bottom portion of the back wall section. One or more side wall panels may be removably attachable to the back wall sections; and a plurality of pins may be provided for securing the back wall section to the base section and the side wall panels to the back wall section. The pins may be provided on the flange of the base section and on a side of each side wall panel adjoining the back wall section. Each of the pins may further include a lower rivet portion and an upper threaded portion separated by a central portion. Pins provided on the flange portion of the base section may be insertable into corresponding openings provided on the ledge of the back wall section. Similarly, pins provided on the side of each side wall panel adjoining the back wall section may be insertable into corresponding openings provided on the side of the back wall section. A fastener may engage the threaded portion of each pin to secure the panels of the multi-piece shower unit.

According to another aspect of the present invention, a method of assembling and installing a multi-piece shower unit into a framing pocket may comprise the step of providing a multi-piece shower unit having a base section with a floor, a plurality of vertically extending sidewalls, and a flange extending horizontally outward along a top portion of vertically extending sidewalls. A back wall section of the multi-piece shower unit may be removably attachable to the base section. The back wall section may have a first surface facing the interior of the shower unit, a second surface opposite the first surface and facing a framing pocket for installing the shower unit, and a ledge provided on the bottom portion of the back wall section. One or more side wall panels may be removably attachable to the back wall section. Additionally, a plurality of pins for securing the back wall section to the base section and the side wall panels to the back wall section. The method may further include the step of providing a plurality of holes on the flange of the base section and a side of each side wall panel adjacent to the back wall section. In the next step, the pins may be inserted into each of the plurality of holes formed on the flange of the base section and a side of each side wall panel. The method may further include the step of providing a plurality of openings on the ledge of the back wall section and a side of the back wall section adjacent to each side wall panel. Additionally, each of the pins on the flange of the base section and the side of the side wall panel may be aligned with a corresponding opening on the back wall section. Furthermore, each of the pins on the flange of the base section and the side of the side wall panel may be inserted into a corresponding opening on the back wall section to secure the back wall section to the base section and each of the side wall sections.

Fasteners may be provided to engage the threaded portion of each pin to secure the back wall section to the base section of each side wall panel to the back wall section. Each of the pins further may include a lower rivet portion and an upper threaded portion separated by a central portion.

According to another embodiment of the present invention, a multi-piece shower unit may include a base section having a floor, a plurality of vertically extending sidewalls and a flange extending along a portion of the vertically extending sidewalls. Additionally, the shower unit may include a plurality of wall panels removably attachable to the base section. The plurality of wall panels may have a first surface facing the interior of the shower unit, a second surface opposite the first surface and facing a framing pocket for installing the shower unit, and a ledge provided on a portion of the wall panels. Furthermore, the shower unit may include a plurality of pins for securing the wall panels to the base section and a plurality of hinged pins for securing the wall panels to each other.

In accordance with another embodiment of the present invention, the pins may be provided on the flange of the base section and hinged pins may be provided on a vertical side of each wall panel. Each hinged pin may include a first member having a pin portion extending from a first body portion and a second member having a receiving space formed inside a second body portion. The pin portion of each hinged pin may be slidingly receivable inside the receiving space.

In a further embodiment, the multi-piece shower unit may further include a grab bar mounted on at least one of the plurality of wall panels. The grab bar may include a plurality of grab bar portions mountable from a front side of the multi-piece shower unit.

These and other features and characteristics of the shower enclosure, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE INVENTION

Figure 1:
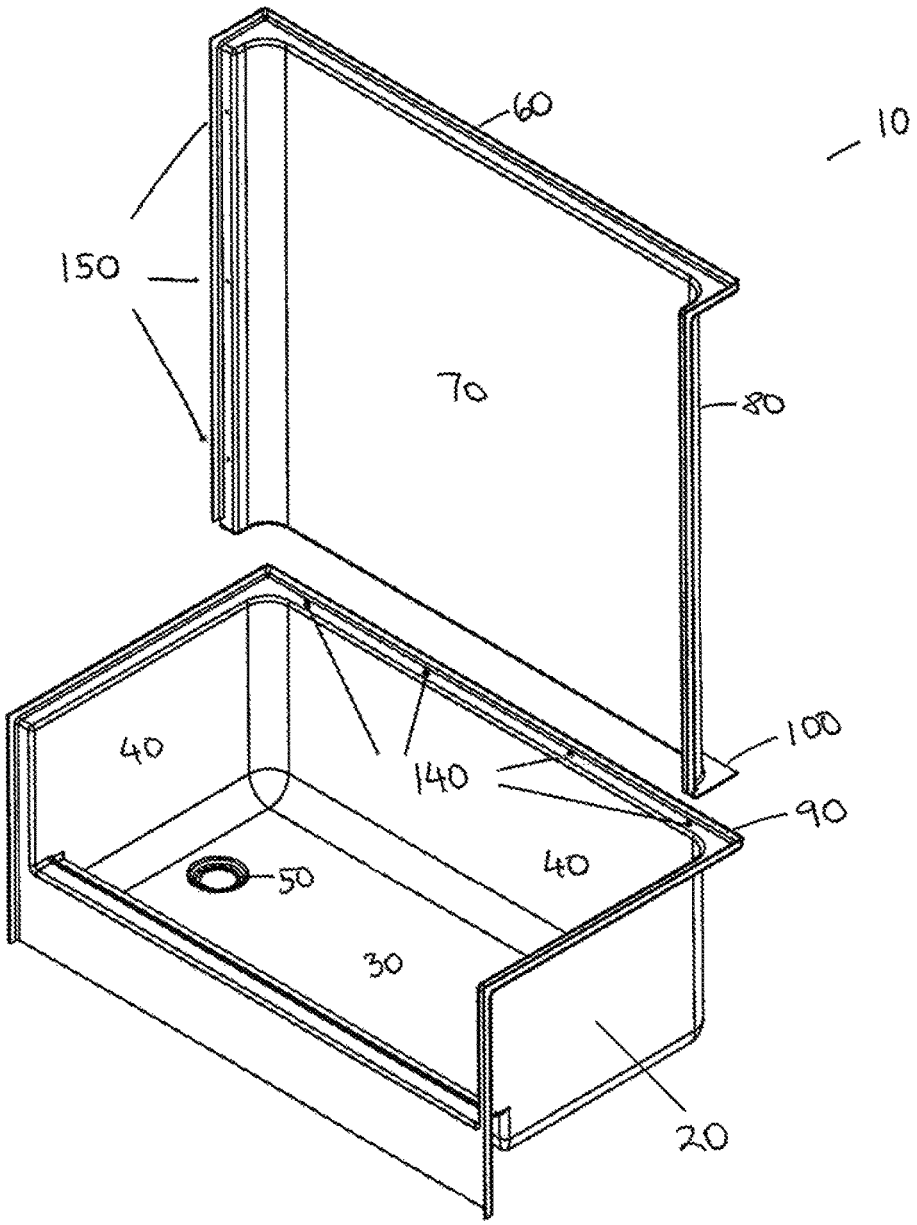
FIG. 1 is an exploded perspective view of a multi-piece shower unit.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Referring to the drawings in which like reference characters refer to like parts throughout the several views thereof, the present invention is generally described in terms of a device and method for assembling, shipping, and installing a multi-piece shower unit.

With reference to FIG. 1, shower unit 10 includes a base section 20 having a floor 30 and a plurality of sidewalls 40 extending vertically from floor 30. A drain outlet 50 is provided on floor 30. Base section 20 may be further provided with one or more openings (not shown) on floor 30 and/or sidewalls 40 for various auxiliary devices, such as faucets or regulators. In the embodiment illustrated in FIG. 1, base section 20 is illustrated as a bathtub unit having a generally rectangular shape. One of ordinary skill in the art will understand that base section 20 may be constructed in a variety of different shapes, including square, triangular, circular, or any other geometric shape.

Figure 2:
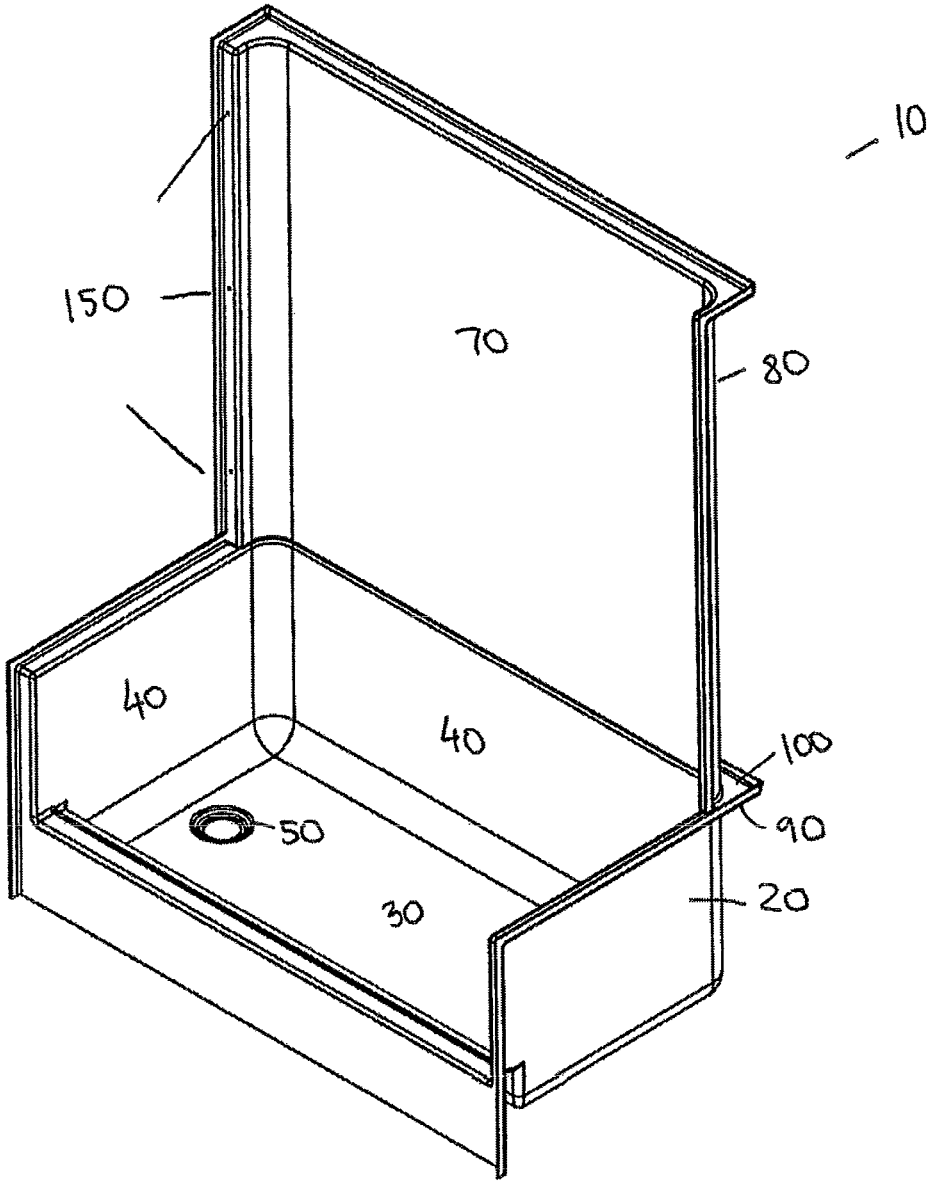
FIG. 2 is a perspective view of the assembled multi-piece shower unit shown in FIG. 1.

With continuing reference to FIG. 1, a back wall section 60 is removably attachable to at least one sidewall 40. Back wall section 60 has a first surface 70 provided opposite a second surface 80. First surface 70 is exposed to the interior of shower unit 10, while second surface 80 is exposed to the interior of a framing pocket (not shown) where shower unit 10 is installed. One or more openings (not shown) may be provided on back wall section 60 for various auxiliary devices, such as faucets, regulators, and/or grab handles. The top portion of sidewalls 40 is provided with a flange 90 for supporting a corresponding ledge 100 provided on the bottom portion of back wall section 60. Flange 90 extends horizontally outward along at least a portion of a plurality of sidewalls 40. As shown in FIG. 2, back wall section 60 is assembled on sidewall 40 of base section 20 by mating ledge 100 with flange 90 to form part of shower unit 10.

Figure 3:
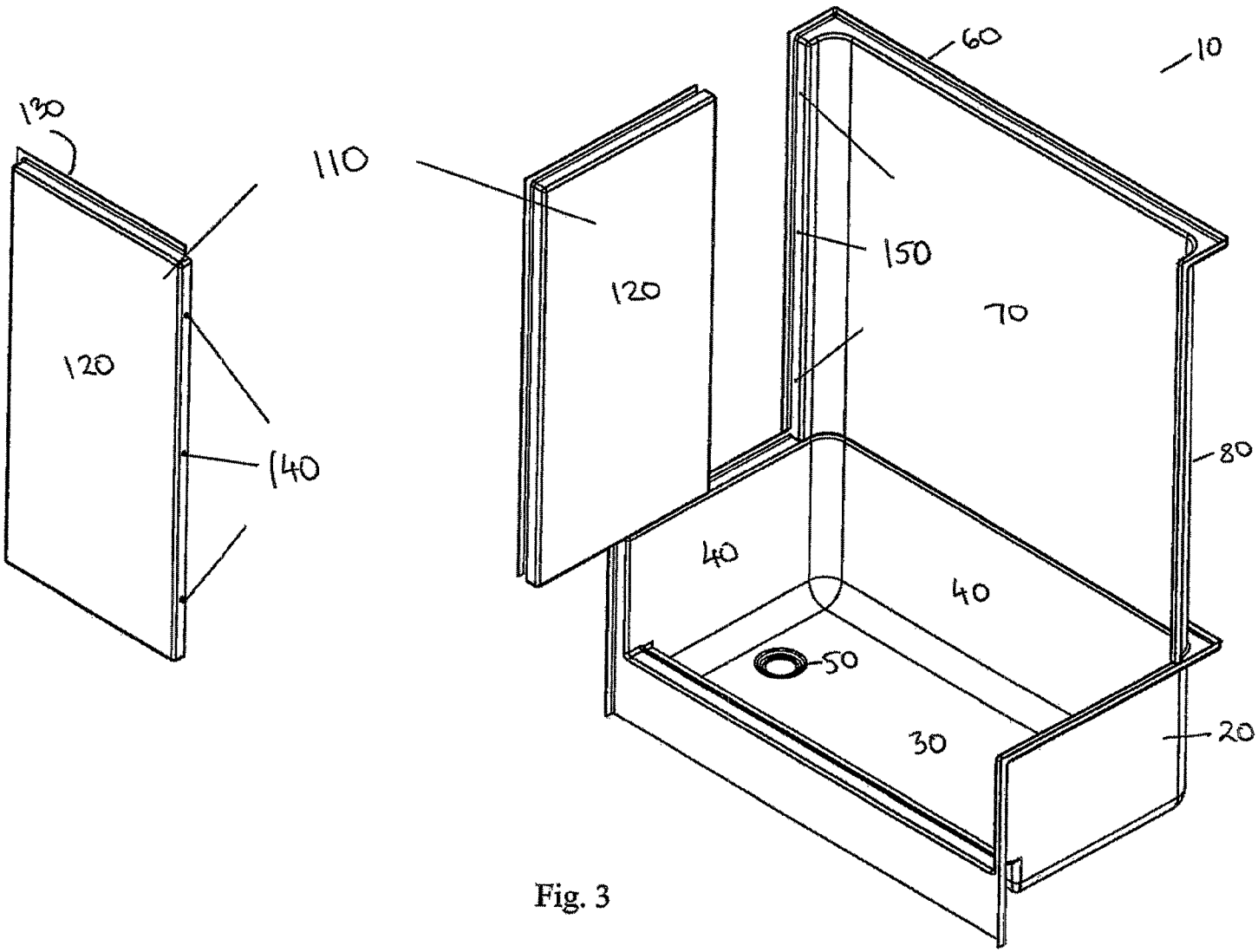
FIG. 3 is an exploded perspective view of the multi-piece shower unit further showing a sidewall panel.
Figure 4:
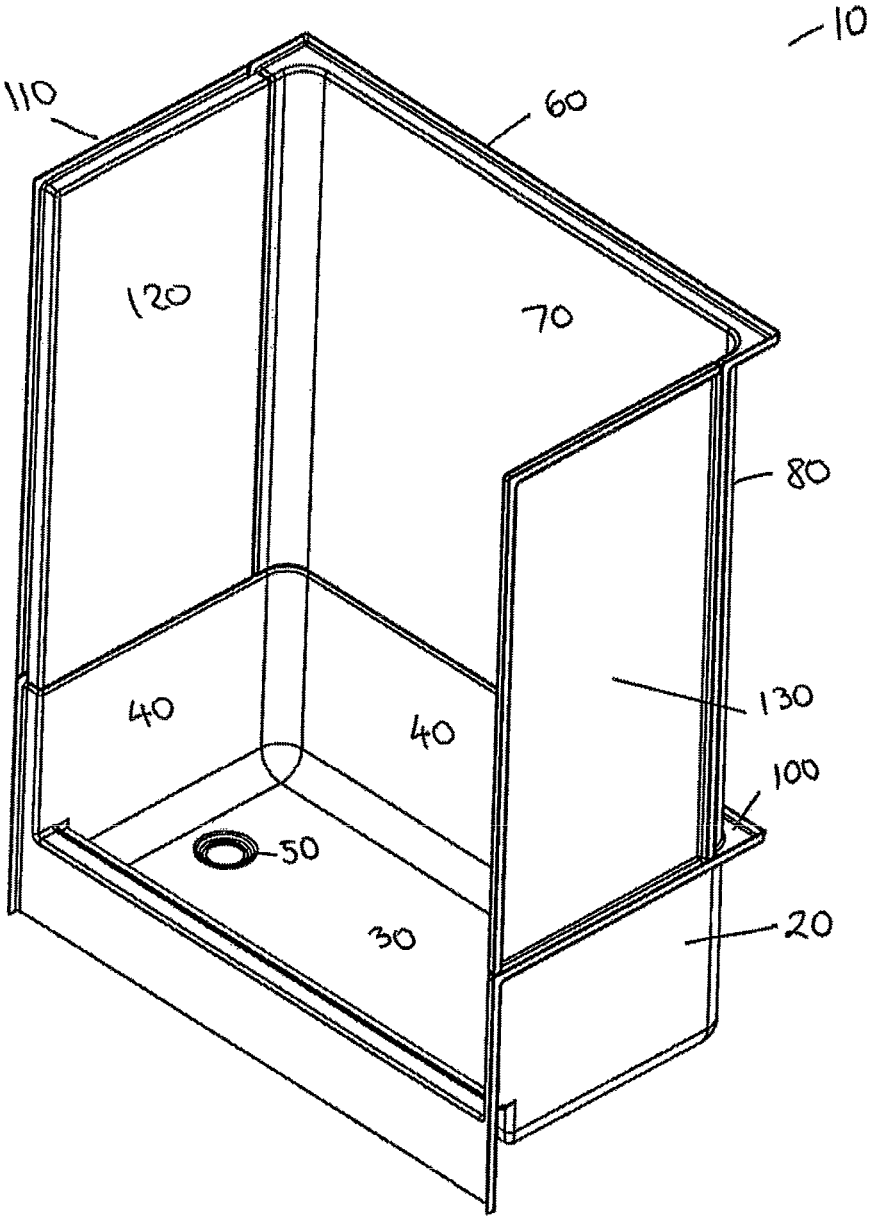
FIG. 4 is a perspective view of the assembled multi-piece shower unit with two sidewall panels.

With reference to FIG. 3, and with continuing reference to FIGS. 1 and 2, shower unit 10 is further provided with at least one side wall panel 110 having a first surface 120 opposite a second surface 130. Similar to back wall section 60, first surface 120 of each side wall panel is exposed to the interior of shower unit 10, while second surface 130 is exposed to the interior of a framing pocket (not shown) where shower unit 10 is installed. Each side wall panel 110 is supported on sidewall 40 of base section 20 in a manner similar to how back wall section 60 is supported on sidewall 40. Furthermore, each side wall panel 110 is removably attachable to back wall section 60. Although FIG. 3 illustrates only one side wall panel 110, FIG. 4 shows two side wall panels 110 provided on top of opposing sidewalls 40 of base section 20. FIG. 4 illustrates a complete assembly of shower unit 10.

Figure 8:
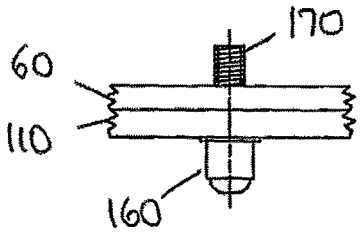
FIG. 8 is a side view of a pin shown in a final assembly state.
Figure 9A:
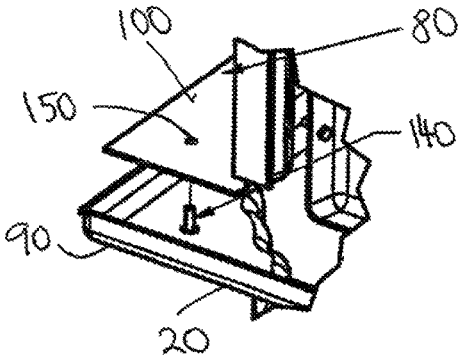
FIGS. 9A and 9B are detailed perspective views of a pin provided on a base section of a multi-piece shower unit.
Figure 9B:
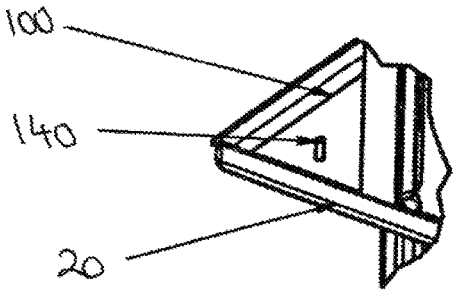

To assemble individual panels of shower unit 10 into a complete assembly, a plurality of pins 140 are provided on one or more of sidewalls 40, back wall section 60, or side wall panels 110. Details of the construction of pins 140 will be explained with more particularity hereafter with reference to FIGS. 5-8. Each pin 140 is insertable into a corresponding opening 150 provided on a mating piece of shower unit 10. As shown in FIG. 1, flange 90 on top of sidewall 40 includes a plurality of pins 140 along the length thereof (FIG. 9A). Back wall section 60 includes a plurality of openings 150 provided on ledge 100. As shown in FIGS. 9A and 9B, pins 140 on flange 90 correspond in location to openings 150 on ledge 100 such that pins 140 may be inserted through openings 150 to secure back wall portion 60 to base section 20.

Figure 10B:
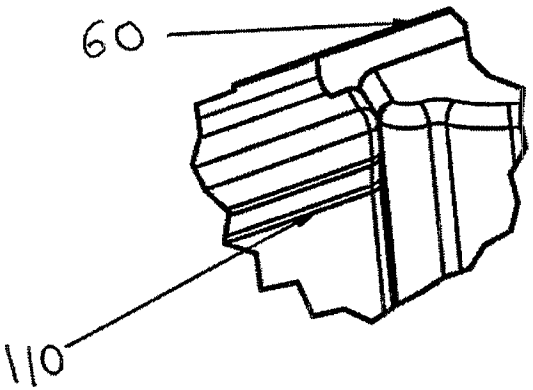
FIGS. 10A and 10B are detailed perspective views of a pin provided on sidewall panels.
Figure 10A:
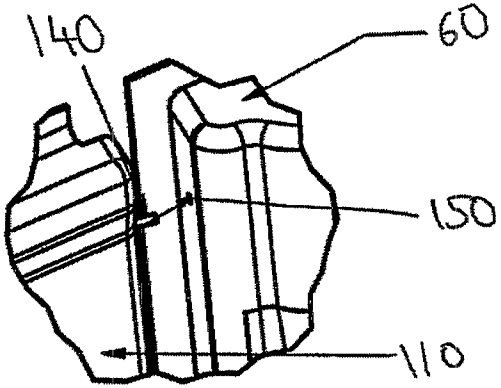

Referring back to FIG. 3, each side wall panel 110 similarly includes a plurality of pins 140 provided on an edge thereof that abuts against back wall section 60. Each pin 140 on side wall panel 110 is insertable into a corresponding opening 150 provided on back wall section 60. As shown in FIGS. 10A and 10B, side wall panel 110 may be secured to back wall section 60 by aligning pins 140 with corresponding openings 150. FIG. 4 illustrates a complete assembly of shower unit 10 where individual pieces of the multi-piece shower unit 10 are secured together using a plurality of pins as described above. Each of back wall section 60 and side wall panels 110 may then be secured inside the framing pocket.

Figure 5:
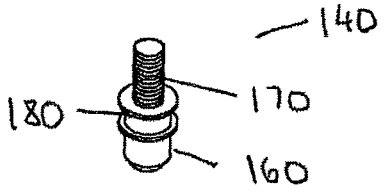
FIG. 5 is a side view of a pin according to an embodiment of the present invention.

With reference to FIG. 5, pin 140 includes a lower rivet portion 160 and an upper threaded portion 170 integrally formed as a single unit. A central portion 180 is provided between lower rivet portion 160 and upper threaded portion 170 for secure attachment to a panel of shower unit 10. Rivet portion 160 is preferably dimensioned such that it may be utilized with conventional riveting equipment. Alternatively, rivet portion 160 may include specific structural features, such as bosses, protrusions, and extensions adapted for use with specialized riveting equipment. Each pin 140 is preferably manufactured from a rust-proof material, such as stainless steel, galvanized steel, aluminum or other suitable materials.

Figure 6:
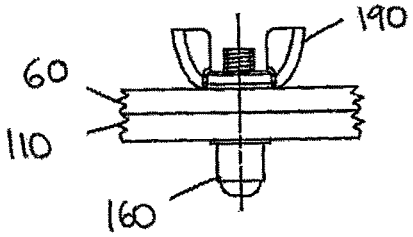
FIG. 6 is a side view of a pin installed on the multi-piece shower unit during shipping.
Figure 7:
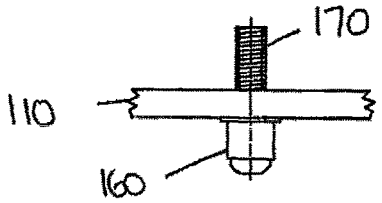
FIG. 7 is a side view of a pin installed on one panel of the multi-piece shower unit.

With reference to FIG. 6, pin 140 is shown assembled on a portion of shower unit 10. In this illustration, pin 140 is secured to a panel of shower unit 10 by riveting central portion 180 to a panel, such as back wall section 60 or side wall panel 110. Threaded portion 170 is inserted into opening 150 provided on a corresponding panel. The two panels of shower unit 10 are secured together for shipment by a fastener 190, such as a wingnut. FIG. 8 illustrates an embodiment where individual panels of shower unit 10 have been installed inside a framing pocket.

Figure 11B:
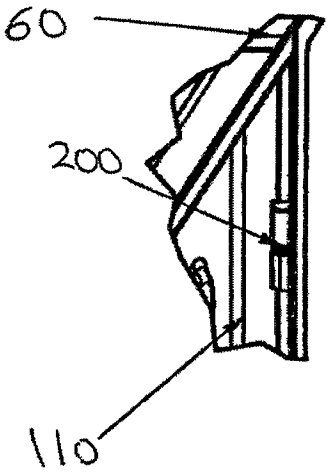
FIGS. 11A and 11B are detailed perspective views of another embodiment of a pin installed on a sidewall of a multi-piece shower unit.
Figure 11A:
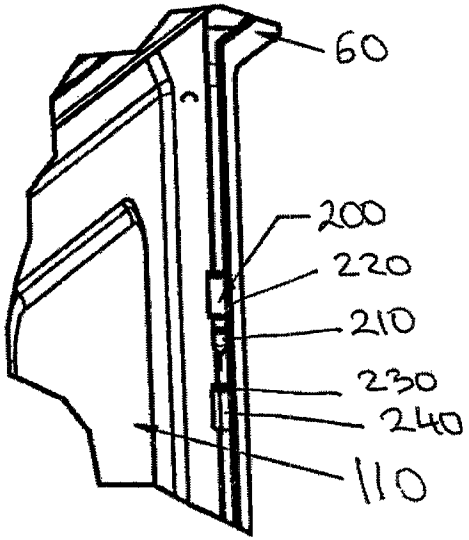

With reference to FIGS. 11A and 11B, another embodiment of hinged pin 200 is illustrated in use on wall sections that incorporate corners. As shown in FIG. 11A, hinged pin 200 includes a first member having a pin portion 210 extending from a first body portion 220 and a second member having a receiving space 230 formed inside a second body portion 240. First body portion 220 is formed on a first wall panel, such as side wall panel 110, while second body portion is formed on a second wall panel, such as back wall section 60. Pin portion 210 is desirably dimensioned such that it is slidingly received inside receiving space 230. Once inserted into receiving space 230, pin portion 210 allows the first wall panel, such as side wall panel 110, to pivot with respect to the second wall panel, such as back wall section 60. Hinged pin 200 is desirably utilized for connecting angled wall sections that incorporate corners, such as a three-piece tub and shower unit having a two-piece wall shower enclosure with a joint in the middle of the two wall sections. FIG. 11B illustrates two wall sections connected by a hinged pin 200.

Pin 140 and hinged pin 200 are associated with a number of advantages for allowing simplified installation compared to existing designs. Shower unit 10 incorporating pin 140, hinged pin 200, or both, can be easily disassembled from shipping and installed from the front side of the shower unit 10. Both pin 140 and hinged pin 200 require less assembly space, less assembly time and therefore are less costly to install.

Figure 12A:
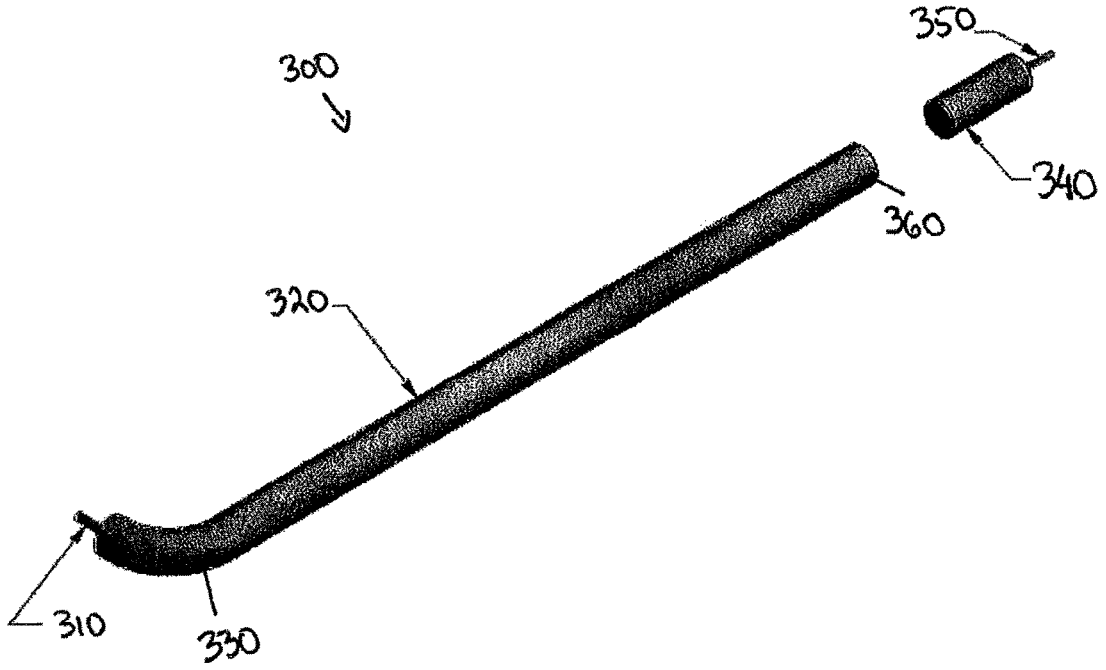
FIGS. 12A and 12B show perspective views of a shower grab bar incorporating a pin in accordance with one embodiment of the present invention.
Figure 12B:
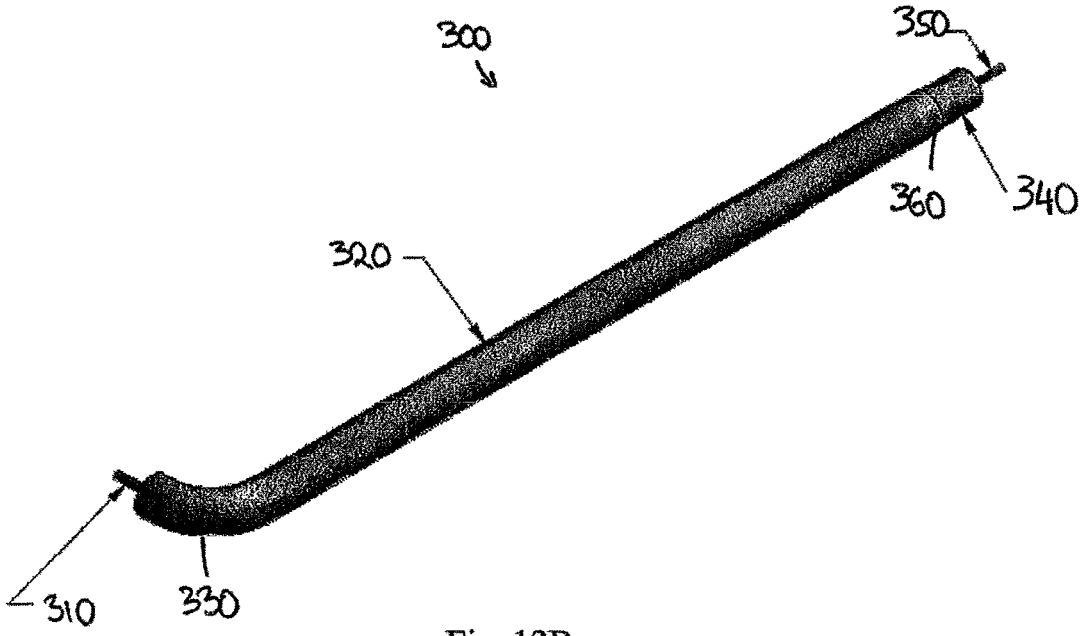

With reference to FIGS. 12A-12B, an embodiment of an ADA-compliant grab bar 300 is shown in combination with pin 310. Grab bar 300 is mountable to vertical walls of shower unit 10, such as back wall section 60 and/or one or more side wall panels 110 (not shown in FIGS. 12A-12B). Grab bar 300 has a generally tubular body portion 320 with one or more bent portions 330. Pin 310 is provided the terminal end of bent portion 330. Pin 310 is coaxial with the longitudinal axis of grab bar 300 and extends outward from the bent portion 330 of grab bar 300. Terminal end 360 of tubular body portion 320 is adapted for receiving a bar receiver 340. With reference to FIG. 12A, bar receiver 340 has a tubular body with a pin 350 located at one terminal end of the body. Pin 350 is coaxial with the longitudinal axis of the tubular body.

In use, pin 350 of bar receiver 340 is inserted into a corresponding receiver pin bolted to the side wall or the back wall. Terminal end 360 of tubular body portion 320 engages bar receiver 340 such that bar receiver 340 is received inside terminal end 360. Pin 310 at bent portion 330 is then inserted into a corresponding receiver pin bolted to the sidewall or the back wall. Terminal end 360 may be secured to bar receiver 340 via a fastener (not shown), such as a set screw.

With the basic structure of shower unit 10 according to an embodiment of the present invention described, a method of manufacture, shipping and installation of shower unit 10 into a framing pocket will now be described in greater detail.

Each panel of multi-piece shower enclosure 10 is preferably manufactured from a fiberglass material or a similar reinforced resin material. During manufacture, each panel is provided with either a hole for pin 140 or opening 150 for inserting pin 140 therethrough. The holes or openings 150 may be drilled or pre-formed during the molding process of each panel. Pins 140 are secured inside the drilled or pre-formed holes. After securing the pins 140 and providing corresponding openings 150, individual panels of shower unit 10 may be assembled for shipping.

Rather than shipping individual panels of shower unit 10 in a disassembled state, pins 140 provide for convenient assembly means that enable for completely assembled shower units to be shipped from a manufacturing facility and delivered to a point of installation. In this manner, the possibility of damage to individual components is reduced because the panels are secured together to form an integral shower unit 10. Furthermore, the need for a temporary framing fixture which secures the individual panels is eliminated.

Before shower unit 10 is shipped to a point of installation, each shower unit 10 may be completely assembled by aligning the individual components of shower unit 10 such that pins 140 are inserted through openings 150. With reference to FIGS. 1-4, pins 140 on flange 90 are aligned with openings 150 on ledge 100 of back wall section 60. Similarly, pins 140 on each of side wall panels 110 are aligned with openings 150 on sides of back wall section 60. Once all of the pins 140 are aligned with openings 150, individual panels may be secured together by threading fasteners 190 along threaded portions 170 of each pin 140.

Once the assembled shower unit 10 is shipped to a point of installation, individual panels may be disassembled by removing fasteners 190 from threaded portions 170 of each pin 140. After preparing the framing pocket, base section 20 is inserted into the framing pocket and leveled.

A drain is connected to drain outlet 50 provided on floor 30 of base section 20. A layer of silicone is provided along the top portion of sidewalls 40 in order to provide a water-tight connection between base section 20 and back wall section 60 and side wall panels 110. Once base section 20 is secured inside the framing pocket, back wall section 60 may be installed by aligning the pins 140 on flange 90 of base section 20 with openings 150 on ledge 100 of back wall section 60. Back wall section 60 could then be leveled and loosely secured to the wall pocket (not shown). After securing back wall section 60 to base section 20 and the wall pocket, side wall panels 110 may be installed by following a similar procedure. Pins 140 provided on each side wall panel 110 are aligned with openings 150 provided on sides of back wall section 60. The bottom side of each side wall panel 110 is desirably slid along the top portion of base section 20 while pins 140 engage openings provided on sides of back wall section 60. Once all panels of shower unit 10 are loosely installed, installation is completed by leveling and plumbing all of the panels and tightening the panels to the wall pocket.

While the device and method of the present invention have been described with respect to preferred embodiments, various modifications and alterations of the present invention may be made without departing from the spirit and scope of the present invention. Although a four-piece shower unit 10 has been used by way of an example, various other shower units having multiple panels are equally applicable to the described embodiments of shower unit 10. The scope of the present invention is defined in the appended claims and equivalents thereto.

The invention claimed is:

1. A multi-piece shower unit comprising:

a base section having a floor, a plurality of vertically extending sidewalls and a flange extending along a portion of the vertically extending sidewalls, the flange having a plurality of openings extending through the flange;

a back wall section removably attachable to the base section, the back wall section having a first surface facing the interior of the shower unit, a second surface opposite the first surface and facing a framing pocket for installing the shower unit, and a ledge provided on a portion of the back wall section;

one or more side wall panels removably attachable to the base section; and a plurality of pins integrally installed on the flange of the base section for securing the base section to the side wall panels and the back wall section, wherein each of the plurality of pins has a lower rivet portion and an upper threaded portion separated by a central portion having a pair of collars, and wherein the central portion of each pin is retained within the corresponding opening on the flange such that the collars are positioned on opposite sides of the flange and the central portion is positioned within the opening of the flange.

2. The multi-piece shower unit according to claim 1, wherein the pins are provided on a side of each side wall panel adjoining the back wall section.

3. The multi-piece shower unit according to claim 2, wherein each of the pins provided on the flange portion of the base section is insertable into the corresponding opening provided on the ledge of the back wall section.

4. The multi-piece shower unit according to claim 2, wherein each of the pins provided on the side of each side wall panel adjoining the back wall section is insertable into the corresponding opening provided on the side of the back wall section.

5. The multi-piece shower unit according to claim 3, wherein a fastener engages the threaded portion of each pin to secure the back wall section to the base section during shipping and prior to installation of the multi-piece shower unit.

6. The multi-piece shower unit according to claim 4, wherein a fastener engages the threaded portion of each pin to secure each side wall panel to the back wall section during shipping and prior to installation of the multi-piece shower unit.

7. A method of assembling and installing a multi-piece shower unit into a framing pocket, the method comprising the steps of:

a) providing a multi-piece shower unit having:

1) a base section having a floor, a plurality of vertically extending sidewalls and a flange extending along a portion of the vertically extending sidewalls;

2) a back wall section removably attachable to the base section, the back wall section having a first surface facing the interior of the shower unit, a second surface opposite the first surface and facing a framing pocket for installing the shower unit, and a ledge provided on a portion of the back wall section;

3) one or more side wall panels removably attachable to the base section; and 4) a plurality of pins integrally installed on the flange of the base section for securing the base section to the back wall section and the side wall panels, each of the plurality of pins having a lower rivet portion and an upper threaded portion separated by a central portion having a pair of collars;

b) providing a plurality of openings on the flange of the base section and a side of each side wall panel adjacent to the back wall section;

(c) providing a plurality of openings on the ledge of the back wall section and a side of the back wall section adjacent to each side wall panel;

(d) aligning each of the pins on the flange of the base section and the side of the side wall panel with a corresponding opening on the back wall section; and (e) inserting each of the pins on the flange of the base section and the side of the side wall panel into a corresponding opening on the back wall section such that the central portion is positioned within the corresponding opening to secure the back wall section to the base section and each of the side wall sections.

8. The method of claim 7, wherein a fastener engages the threaded portion of each pin to secure the back wall section to the base section during shipping and prior to installation of the multi-piece shower unit.

9. A multi-piece shower unit comprising:

a base section having a floor, a plurality of vertically extending sidewalls and a flange extending along a portion of the vertically extending sidewalls, the flange having a plurality of openings extending through the flange;

a plurality, of wall panels removably attachable to the base section, the plurality of wall panels having a first surface facing the interior of the shower unit, a second surface opposite the first surface and facing a framing pocket for installing the shower unit, and a ledge provided on a portion of the wall panels;

a plurality of pins integrally installed on the flange of the base section for securing the wall panels to the base section; and a plurality of hinged pins for securing the wall panels to each other, wherein each of the plurality of pins has a lower rivet portion and an upper threaded portion separated by a central portion having a pair of collars, and wherein the central portion of each pin is retained within the corresponding opening on the flange such that the collars are positioned on opposite sides of the flange and the central portion is positioned within the opening of the flange.

10. The multi-piece shower unit according to claim 9, wherein hinged pins are provided on a vertical side of each wall panel.

11. The multi-piece shower unit according to claim 10, wherein each of the pins provided on the flange portion of the base section is insertable into the corresponding opening provided on the ledge of the each wall panel.

12. The multi-piece shower unit according to claim 9, wherein each hinged pin includes a first member having a pin portion extending from a first body portion and a second member having a receiving space formed inside a second body portion.

13. The multi-piece shower unit according to claim 12, wherein the pin portion of each hinged pin is slidingly receivable inside the receiving space.

14. The multi-piece shower unit according to claim 9, further comprising a grab bar mounted on at least one of the plurality of wall panels.

15. The multi-piece shower unit according to claim 14, wherein the grab bar includes a plurality of grab bar portions mountable from a front side of the multi-piece shower unit.

16. The multi-piece shower unit according to claim 1, wherein the pins are metal pins.

17. The multi-piece shower unit according to claim 1, further comprising a grab bar mounted on at least one of the plurality of wall panels.

18. The multi-piece shower unit according to claim 17, wherein the grab bar includes a plurality of grab bar portions mountable from a front side of the multi-piece shower unit.

* * * * *